US011316314B2

(12) United States Patent
Feng et al.

(10) Patent No.: US 11,316,314 B2
(45) Date of Patent: Apr. 26, 2022

(54) CONDUCTIVE SLIP RING

(71) Applicant: LUXSHARE PRECISION INDUSTRY CO., LTD., Shenzhen (CN)

(72) Inventors: Yun Feng, Shenzhen (CN); Min Fan, Shenzhen (CN); Li Fan, Shenzhen (CN)

(73) Assignee: LUXSHARE PRECISION INDUSTRY CO., LTD., Shenzhen (CN)

( * ) Notice: Subject to any disclaimer, the term of this patent is extended or adjusted under 35 U.S.C. 154(b) by 190 days.

(21) Appl. No.: 16/846,748

(22) Filed: Apr. 13, 2020

(65) Prior Publication Data

US 2020/0335925 A1 Oct. 22, 2020

(30) Foreign Application Priority Data

Apr. 22, 2019 (CN) ..... 201910325309.0

(51) Int. Cl.
*H01R 39/08* (2006.01)
*H01R 39/16* (2006.01)

(52) U.S. Cl.
CPC ..... *H01R 39/08* (2013.01); *H01R 39/16* (2013.01)

(58) Field of Classification Search
CPC ..... H01R 39/08; H01R 24/58; H01R 35/04; H01R 39/16
See application file for complete search history.

(56) References Cited

U.S. PATENT DOCUMENTS 4,684,179 A * 8/1987 Freeman ..... H01R 39/08 29/597
5,612,584 A * 3/1997 York ..... H01R 39/08 310/232
8,348,677 B2 * 1/2013 Angerpointner ..... H01R 39/64 439/23

(Continued)

FOREIGN PATENT DOCUMENTS

CN 104022379 A 9/2014
CN 206283084 U 6/2017
JP 51-155303 U 12/1976

(Continued)

*Primary Examiner* — Renee S Luebke
*Assistant Examiner* — Paul D Baillargeon
(74) *Attorney, Agent, or Firm* — Birch, Stewart, Kolasch & Birch, LLP

(57) ABSTRACT

The present disclosure disclosed a conductive slip ring including a first terminal group and a second terminal group. The first terminal group includes a first terminal and a second terminal. The first terminal has a first contact portion provided with a first annular contact surface. The second terminal has a second contact portion provided with a second annular contact surface. The second terminal group includes a third terminal and a fourth terminal. The third terminal is in rotating contact with the first annular contact surface of the first terminal. The fourth terminal is in rotating contact with the second annular contact surface of the second terminal. The first annular contact surface and the second annular contact surface are spaced apart from each other along an axial direction of the conductive slip ring. As a result, structure of the conductive slip ring can be made in a more compact manner.

18 Claims, 16 Drawing Sheets

(56) References Cited

U.S. PATENT DOCUMENTS

| | | | | |
|---|---|---|---|---|
| 2012/0115335 | A1* | 5/2012 | Yamamoto | H01R 13/6473 439/28 |
| 2016/0043505 | A1* | 2/2016 | Wu | H01R 35/02 439/217 |

FOREIGN PATENT DOCUMENTS

| | | | |
|---|---|---|---|
| JP | 55-67670 | U | 5/1980 |
| JP | 2-97789 | U | 8/1990 |
| JP | 9-135553 | A | 5/1997 |
| JP | 10-336972 | A | 12/1998 |
| JP | 11-329653 | A | 11/1999 |
| JP | 2009-110727 | A | 5/2009 |

* cited by examiner

CONDUCTIVE SLIP RING

CROSS-REFERENCE TO RELATED APPLICATION

This patent application claims priority of a Chinese Patent Application No. 201910325309.0, filed on Apr. 22, 2019 and titled "Conductive Slip Ring", the entire content of which is incorporated herein by reference.

TECHNICAL FIELD

The present disclosure relates to a conductive slip ring, which belongs to a technical field of connectors.

BACKGROUND

Conductive slip rings belong to an application category of electrical contact sliding connection. The conductive slip ring is also called a connecting ring, a rotary joint, a rotary electrical interface, a slip ring, a current collector ring, a return ring, a coil, a commutator or an adapter etc. The conductive slip ring is a precision power transmission device which is used to realize transmission of image, data signal and power of two relative rotating mechanisms. It is particularly suitable for applications where there is no limit to continuous rotation, while power or data needs to be transmitted from a fixed position to a rotating position. The conductive slip ring includes an elastic material (such as an electric brush), a sliding contact surface material (such as a conductive slip ring), an insulating material, a bonding material, combined brackets, precision bearings, a dust cover and other auxiliary parts. The brush is normally made of precious metal alloy materials. The brush is normally of a "H"-shaped configuration which is symmetrically in contact with ring grooves of the conductive slip ring. The electric brush uses its elastic pressure to make sliding contact with the ring grooves of the conductive slip ring to transmit signals and currents, which is a key component of various precision turntables, centrifuges and inertial guidance equipment. The conductive slip ring can be widely used in various mechanical and electrical equipment such as security, factory automation, power, finance, instrumentation, chemicals, metallurgy, medical, aviation, military, shipping, transportation and construction etc.

The existing conductive slip ring generally includes a plurality of cylindrical terminals which generally need to be electrically connected to connection elements (such as cables). However, how to arrange these terminals more effectively and how to facilitate the electrical connection between these terminals and the connection elements are technical issues need to be solved in the industry.

SUMMARY

An object of the present disclosure is to provide a conductive slip ring with a compact structure and convenient for connecting terminals.

To achieve the above objective, the present disclosure disclosed a conductive slip ring including a first terminal group and a second terminal group. The first terminal group includes a first terminal and a second terminal which is not in contact with the first terminal. The first terminal has a first contact portion and a first extension portion connected to the first contact portion. The first contact portion is provided with a first annular contact surface. The second terminal has a second contact portion and a second extension portion connected to the second contact portion. The second contact portion is provided with a second annular contact surface. The second terminal group includes a third terminal and a fourth terminal. The third terminal is in rotating contact with the first annular contact surface of the first terminal. The fourth terminal is in rotating contact with the second annular contact surface of the second terminal. The first annular contact surface and the second annular contact surface are spaced apart from each other along an axial direction of the conductive slip ring. The first extension portion extends through the second contact portion along the axial direction of the conductive slip ring and is at least partially inserted into the second extension portion. The first extension portion and the second extension portion are adapted to electrically connect with a first connection port. The third terminal and the fourth terminal are adapted to electrically connect with a second connection port.

Preferably, the conductive slip ring further includes a molded part with which the first terminal and the second terminal are insert-molded. The first contact portion and the second contact portion are spaced apart from each other along the axial direction of the conductive slip ring. The first contact portion is of a ring shape. The second extension portion is inserted into the first contact portion. The second contact portion is of a ring shape or a cylindrical shape.

Preferably, the molded part is provided with a support portion. The first extension portion includes a first tail portion exposed on the support portion, and the second extension portion includes a second tail portion exposed on the support portion. The first connection port includes a first cable connected to the first tail portion and a second cable connected to the second tail portion.

Preferably, the conductive slip ring further includes a protective sleeve sleeved on the support portion to at least partially shield the first tail portion and the second tail.

Preferably, the molded part is provided with a bearing seat and the conductive slip ring includes a bearing mounted on the bearing seat. The bearing includes an outer ring portion and an inner ring portion which is rotatable relative to the outer ring portion. The inner ring portion is fixed to the bearing seat. The conductive slip ring includes a housing to fix the third terminal and the fourth terminal. The outer ring portion is fixed to the housing.

Preferably, the second connection port is provided with a third cable connected to the third terminal and a fourth cable connected to the fourth terminal. The conductive slip ring includes a first protection member covering a portion where the third terminal and the third cable are connected, and a second protection member covering a portion where the fourth terminal and the fourth cable are connected. Both the first protection member and the second protection member are mounted to the housing.

Preferably, the housing includes a first housing and a second housing fixed to the first housing. The first protection member is mounted to the first housing. The second protection member is mounted to the second housing. The conductive slip ring further includes a shell enclosing the housing.

Preferably, a diameter of the first annular contact surface is the same as a diameter of the second annular contact surface.

Preferably, each of the third terminal and the fourth terminal includes a connection portion, a first contact arm and a second contact arm. The first contact arm and the second contact arm are bent and extended from lateral sides of the connection portion, respectively. The first terminal is rotatable relative to the third terminal, while keeping the first contact arm and the second contact arm of the third terminal always clamp the first annular contact surface. The second terminal is rotatable relative to the fourth terminal, while keeping the first contact arm and the second contact arm of the fourth terminal always clamp the second annular contact surface.

Preferably, one of the first terminal and the second terminal is a power terminal, and the other is a ground terminal.

Compared with the prior art, according to the present disclosure, the first extension portion of the first terminal is set to extend through the second contact portion of the second terminal along the axial direction of the conductive slip ring and is at least partially inserted into the second extension portion. The first terminal and the second terminal are arranged by utilizing an axial distance of the conductive slip ring, which on one hand makes the structure more compact; and on the other hand, the first extension portion and the second extension portion can be made as close as possible to each other, thereby facilitating connection with the first connection port.

DETAILED DESCRIPTION

Figure 1:
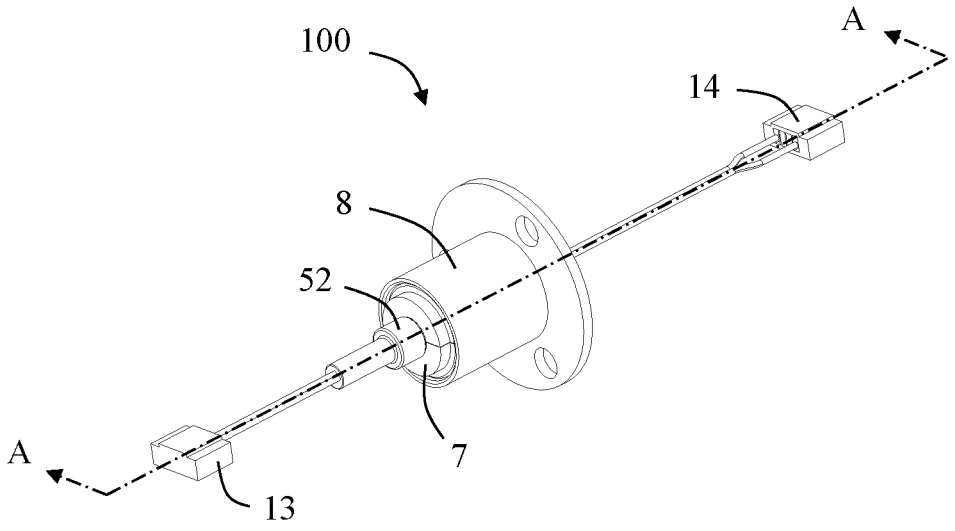
FIG. 1 is a perspective view of a conductive slip ring according to an embodiment of the present disclosure.
Figure 2:
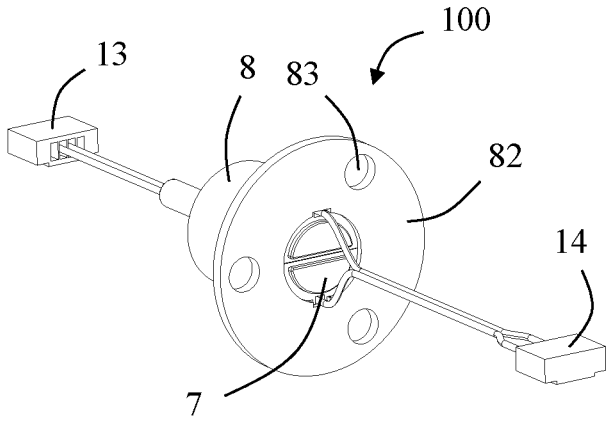
FIG. 2 is another perspective view of FIG. 1.
Figure 3:
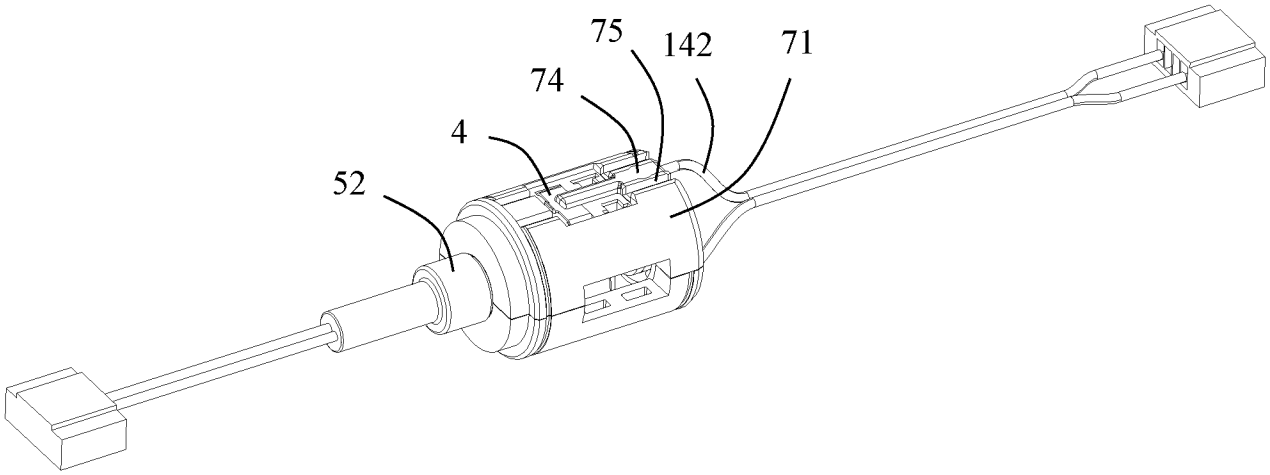
FIG. 3 is a partially perspective view of the conductive slip ring with a shell in FIG. 1 removed.
Figure 4:
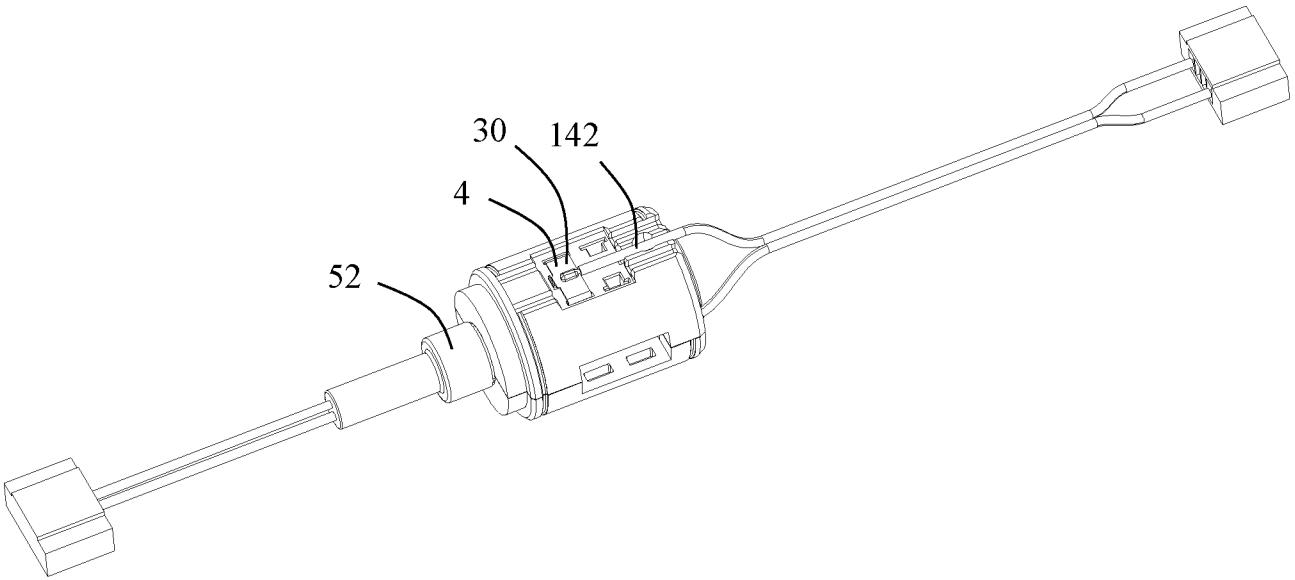
FIG. 4 is a partially perspective view of the conductive slip ring with a second protection member in FIG. 3 removed.
Figure 5:
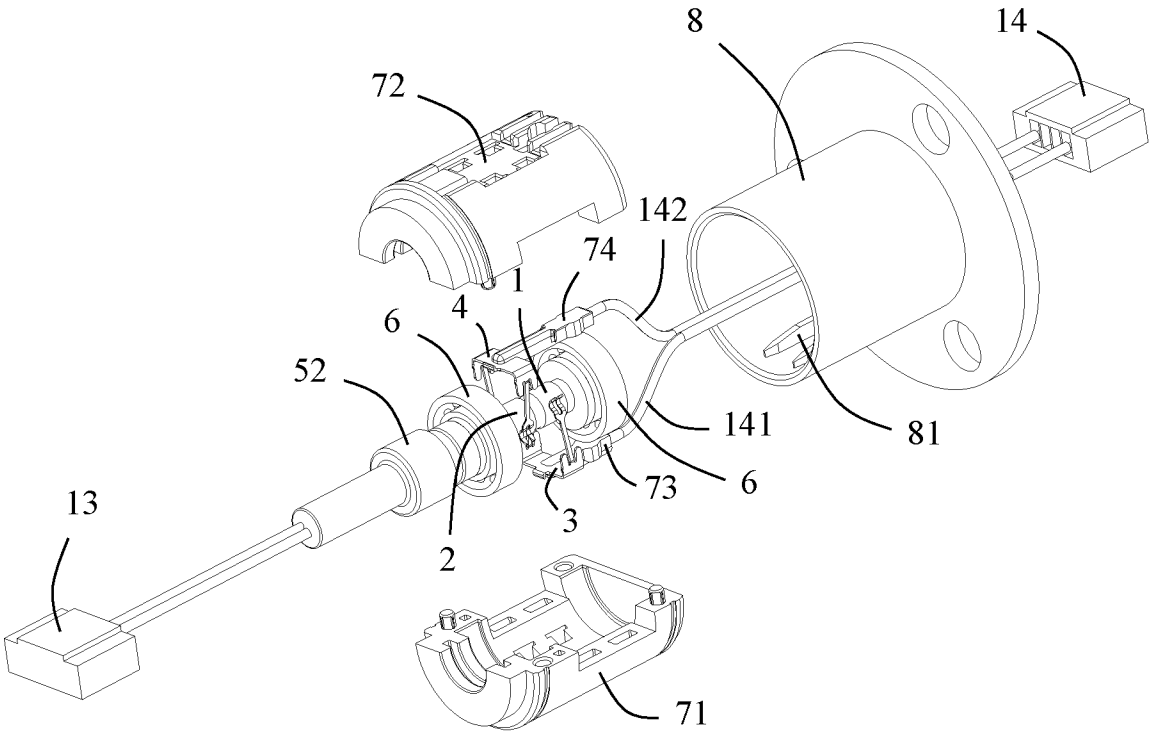
FIG. 5 is a partially exploded view of FIG. 1, in which the shell and the housing are separated.

Referring to FIGS. 1 to 17, an illustrated embodiment of the present disclosure discloses a conductive slip ring 100 including a first terminal group 10 (see FIG. 12), a second terminal group 20 (see FIG. 6), a molded part 5 fixed to the first terminal group 10, a bearing 6 mounted to the molded part 5, a housing 7 that cooperates with the bearing 6 and encloses the first terminal group 10, and a shell 8 assembled and fixed to an outside of the housing 7.

Referring to FIGS. 11 to 14, in the illustrated embodiment of the present disclosure, the first terminal group 10 includes a first terminal 1 and a second terminal 2 which is not in electrical contact with the first terminal. The second terminal group 20 includes a third terminal 3 electrically connected to the first terminal 1 and a fourth terminal 4 electrically connected to the second terminal 2. In the illustrated embodiment of the present disclosure, one of the first terminal 1 and the second terminal 2 is a power terminal, and the other is a ground terminal. Of course, in other embodiments, the first terminal 1 and the second terminal 2 may also be signal terminals, and the number of terminals in the first terminal group 10 may also be more than two.

From a structural point of view, in the illustrated embodiment of the present disclosure, the first terminal 1 is provided with a first contact portion 11 and a first extension portion 12 connected to the first contact portion 11. The first contact portion 11 is provided with a first annular contact surface 111 that is in contact with the third terminal 3. The second terminal 2 is provided with a second contact portion 21 and a second extension portion 22 connected to the second contact portion 21. The second contact portion 21 is provided with a second annular contact surface 211 that is in contact with the fourth terminal 4. In the illustrated embodiment of the present disclosure, the first contact portion 11 is also of a ring shape into which the second extension portion 22 is inserted. The second contact portion 21 is of a ring shape or a cylindrical shape. Referring to FIGS. 11 to 14, the first extension portion 12 extends through the second contact portion 21 along an axial direction of the conductive slip ring 100 and is at least partially inserted into the second extension portion 22. In this way, an axial distance of the conductive slip ring 100 is used to arrange the first terminal 1 and the second terminal 2 to achieve relatively compact structure.

Figure 11:
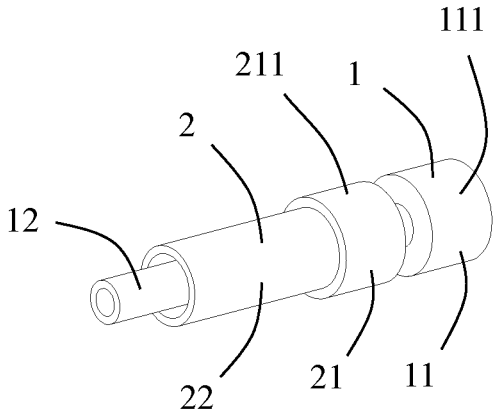
FIG. 11 is a schematic perspective view after the molded part in FIG. 10 is removed.
Figure 12:
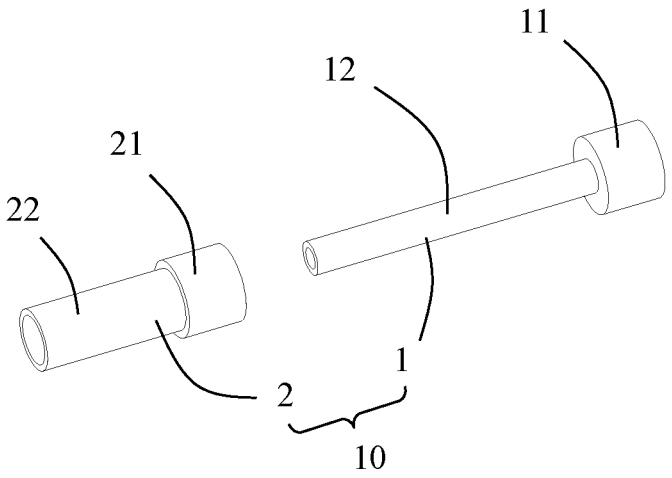
FIG. 12 is an exploded view of FIG. 11.
Figure 13:
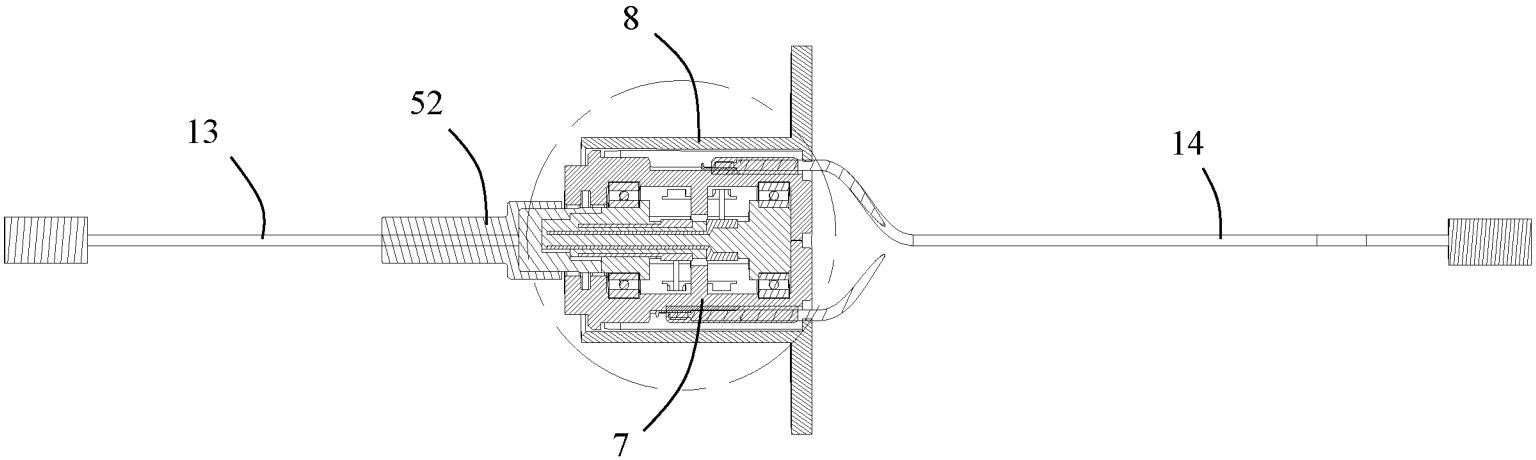
FIG. 13 is a schematic cross-sectional view taken along the line A-A in FIG. 1.
Figure 14:
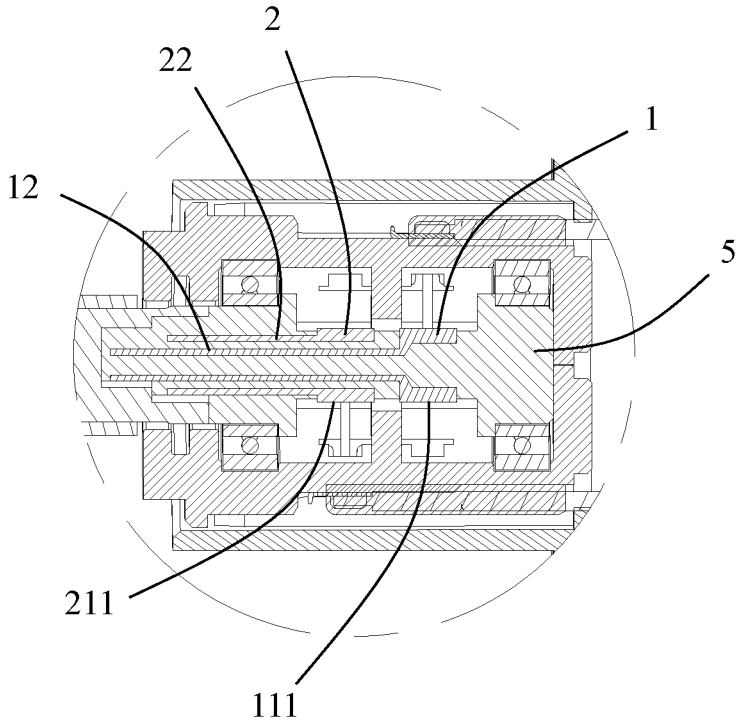
FIG. 14 is a partially enlarged view of a circled portion in FIG. 13.
Figure 15:
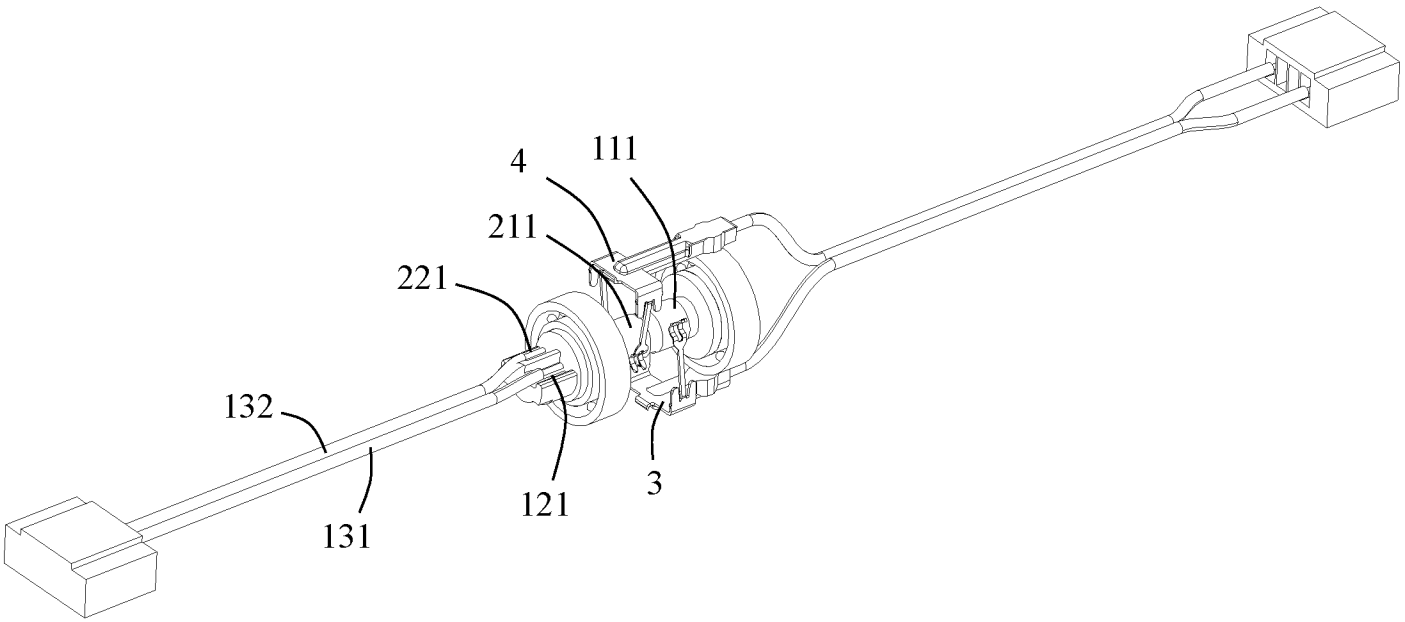
FIG. 15 is a schematic perspective view of another embodiment of FIG. 8.
Figure 16:
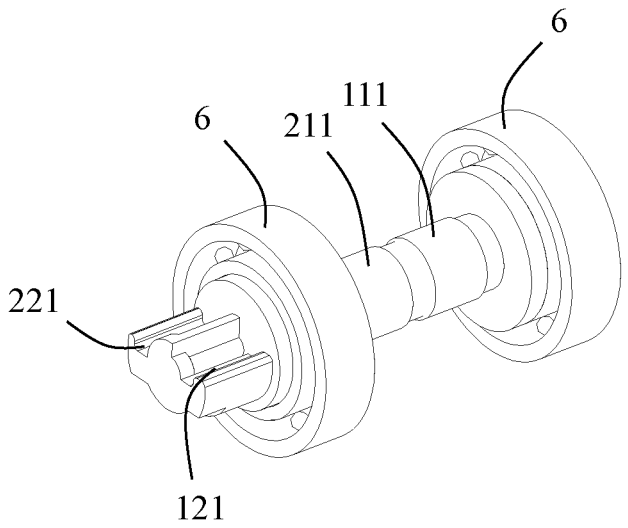
FIG. 16 is a perspective view when the first terminal group, the molded part and the bearing in FIG. 15 are assembled together.
Figure 17:
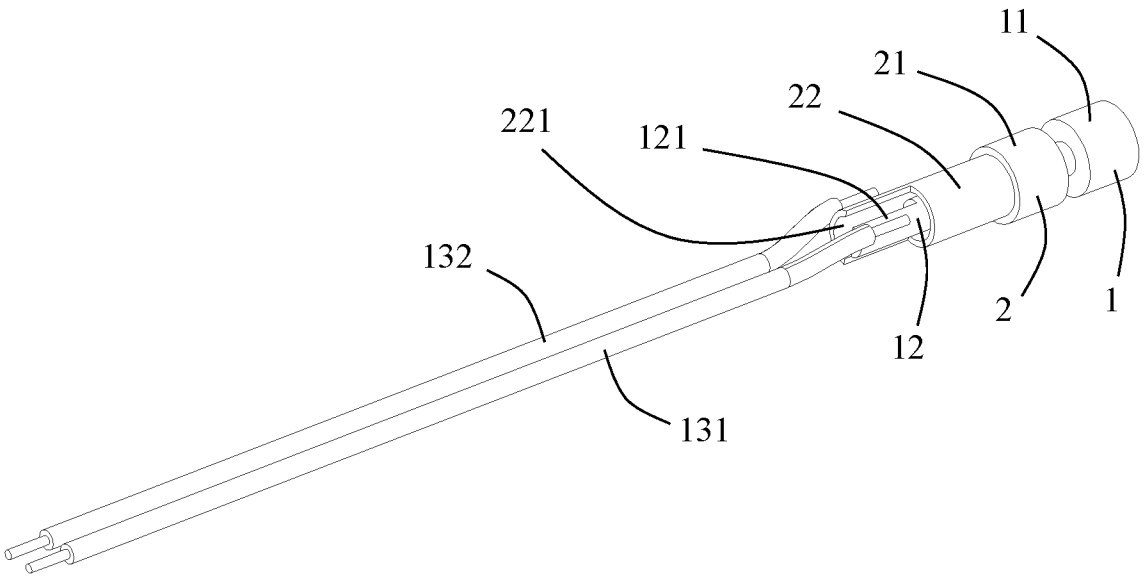
FIG. 17 is a schematic perspective view of a first cable, a second cable and the first terminal group welded together of FIG. 15.

The first terminal 1 and the second terminal 2 can be fixed to the molded part 5 through a general positioning structure (such as a positioning groove), so that the first terminal 1 and the second terminal 2 do not contact with each other, thus avoiding short circuit. Of course, since the first terminal 1 and the second terminal 2 having cylindrical step shapes are difficult to position, in order to better solve the positioning problem, in the illustrated embodiment of the present disclosure, the first terminal 1 and the second terminal 2 are insert-molded with the molded part 5. Referring to FIGS. 11 and 14, the first contact portion 11 and the second contact portion 21 are spaced apart from each other in the axial direction of the conductive slip ring 100. Preferably, the first contact portion 11 and the second contact portion 21 are separated by an isolation portion 50 of the molded part 5 in the axial direction of the conductive slip ring 100.

The molded part 5 is provided with a supporting portion 51. The first extension portion 12 is provided with a first tail portion 121 exposed on the support portion 51, and the second extension portion 22 is provided with a second tail portion 221 exposed on the support portion 51. Layout of the first tail portion 121 and the second tail portion 221 may be of a top and bottom arrangement (see FIGS. 7 to 10) or a left and right arrangement (see FIGS. 15 to 17). Of course, it can be understood that the first tail portion 121 and the second tail portion 221 may also be arranged in other ways, such as being arranged back and forth along the axial direction of the conductive slip ring 100 etc. Among the above-mentioned various layouts of the first tail portion 121 and the second tail portion 221, those that facilitate to improve the stability of the process and improve the welding efficiency are all preferred solutions, which are not repeated here.

Referring to FIGS. 1 to 8, the first extension portion 12 and the second extension portion 22 are configured to be electrically connected to the first connection port 13. In the illustrated embodiment of the present disclosure, the first connection port 13 is a cable connector assembly, which includes a first cable 131 connected to the first tail portion 121, a second cable 132 connected to the second tail portion 221, and a first connector 133.

Referring to FIGS. 1 to 7, in order to increase the structural strength of the first tail portion 121 and the second tail portion 221 when welded with the first cable 131 and the second cable 132, respectively, and to prevent welding portions from being easily oxidized due to exposure to the air, the conductive slip ring 100 further includes a protective sleeve 52 sleeved on the support portion 51 to cover the first tail portion 121 and the second tail portion 221. The protective sleeve 52 is injection molded or assembled.

Figure 9:
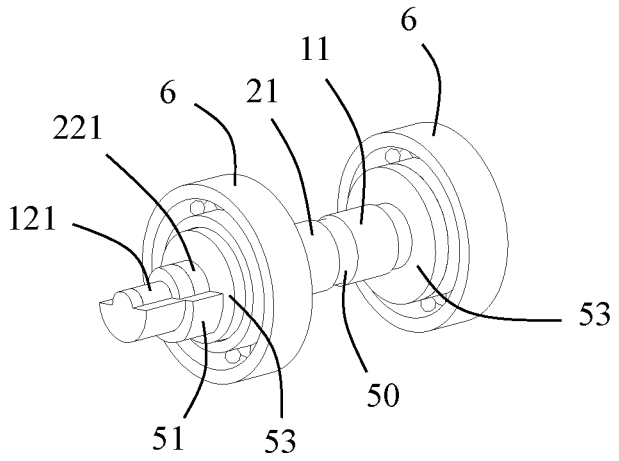
FIG. 9 is a perspective view when a first terminal group, a molded part and a bearing in FIG. 8 are assembled together.
Figure 10:
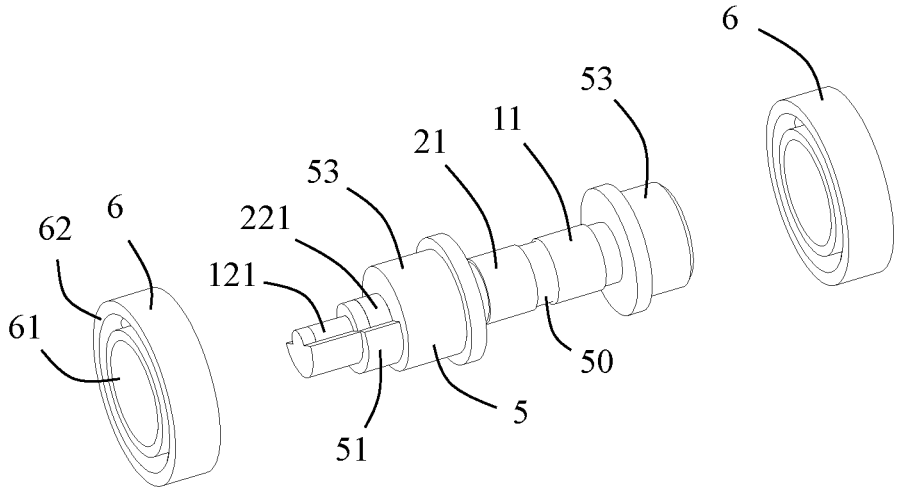
FIG. 10 is an exploded view of FIG. 9.

In an application of the conductive slip ring 100 of the present disclosure, an electronic component connected to the first connection port 13 may change position (for example, rotation). By providing the bearing 6, on one hand, the resistance to rotation can be reduced to make rotation be easy; on the other hand, the mounting accuracy can be improved, thereby improving the contact reliability between corresponding terminals. Referring to FIGS. 9 and 10, the molded part 5 is provided with a bearing seat 53 on which the bearing 6 is mounted. In the illustrated embodiment of the present disclosure, the molded part 5 is provided with two bearing seats 53 respectively located at two ends of the first terminal group 10 to further reduce the rotation resistance and improve the contact reliability between corresponding terminals. Accordingly, there are two bearings 6 respectively mounted on the corresponding bearing seats 53. For those of ordinary skill in the art, they know or can find different types of bearings 6 from related fields without creative efforts. In an embodiment of the present disclosure, the bearing 6 is a ball bearing, which includes an outer ring portion 62, an inner ring portion 61 rotatable with respect to the outer ring portion 62, and a plurality of balls mounted between the inner ring portion 61 and the outer ring portion 62. The inner ring portion 61 is fixed to the bearing seat 53, and the outer ring portion 62 is fixed on the housing 7.

In the illustrated embodiment of the present disclosure, the housing 7 includes a first housing 71 and a second housing 72 assembled and fixed to the first housing 71. The third terminal 3 and the fourth terminal 4 are fixed to the first housing 71 and the second housing 72, respectively. As to how the third terminal 3 and the fourth terminal 4 are fixed to the first housing 71 and the second housing 72, various manners well known to those skilled in the art can be adopted. For example, mounting grooves are provided in the first housing 71 and the second housing 72, and fixing portions are provided on the third terminal 3 and the fourth terminal 4 to be held in the mounting grooves for terminal installation. In other embodiments, the third terminal 3 and the fourth terminal 4 may also be fixed to the first housing 71 and the second housing 72 by insert molding.

The third terminal 3 and the fourth terminal 4 are adapted to be electrically connected to a second connection port 14. The second connection port 14 is provided with a third cable 141 connected to the third terminal 3, a fourth cable 142 connected to the fourth terminal 4, and a second connector 143. The conductive slip ring 100 includes a first protection member 73 covering a portion where the third terminal 3 and the third cable 141 are connected, and a second protection member 74 covering a portion where the fourth terminal 4 and the fourth cable 142 are connected. The first protection member 73 and the second protection member 74 are mounted on the first housing 71 and the second housing 72, respectively. In an embodiment of the present disclosure, the portion where the third terminal 3 is connected to the third cable 141 and the portion where the fourth terminal 4 is connected to the fourth cable 142 are both welded portions. As a result, on one hand, the first protection member 73 and the second protection member 74 can improve the structural strength after welding, and on the other hand, it can also prevent the welded portions from being easily oxidized due to exposure to the air.

The housing 7 and the shell 8 are assembled and fixed to each other through a plurality of grooves 75 and protruding ribs 81 arranged along the axial direction of the conductive slip ring 100. The shell 8 is provided with a mounting flange 82 for mounting the conductive slip ring 100 to other components, and the mounting flange 82 is provided with a plurality of mounting holes 83.

In the illustrated embodiment of the present disclosure, positions of the housing 7, the housing 8, the second terminal group 20 and the second connection port 14 are generally fixed (referred to as "a stator"), and the first terminal group 10, the molded part 5, the protective sleeve 52, the first connection port 13 are rotatable via the bearing 6 (referred to as "a rotor"). This arrangement is particularly suitable for applications where the electronic device connected to the first connection port 13 is continuously rotated indefinitely, and power or data needs to be transmitted from a fixed position to a rotated position.

Preferably, a diameter of the first annular contact surface 111 is the same as a diameter of the second annular contact surface 211, so that the third terminal 3 and the fourth terminal 4 can adopt the same terminal for saving cost.

Figure 6:
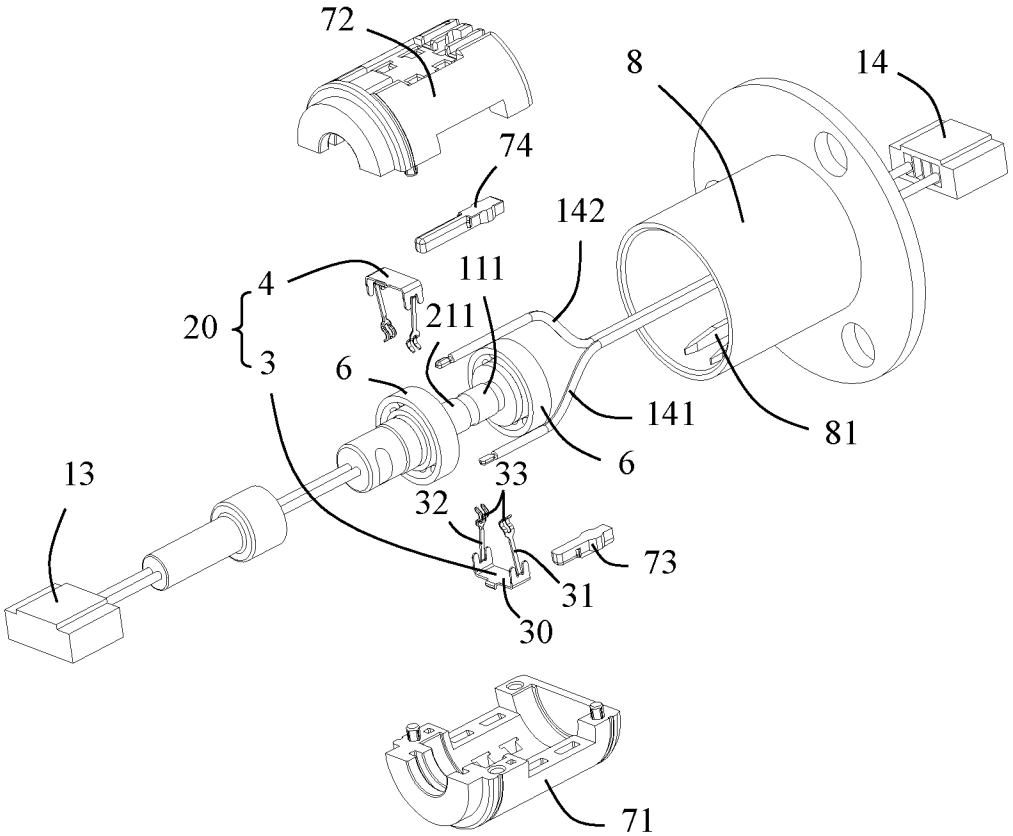
FIG. 6 is a further exploded view of FIG. 5.
Figure 7:
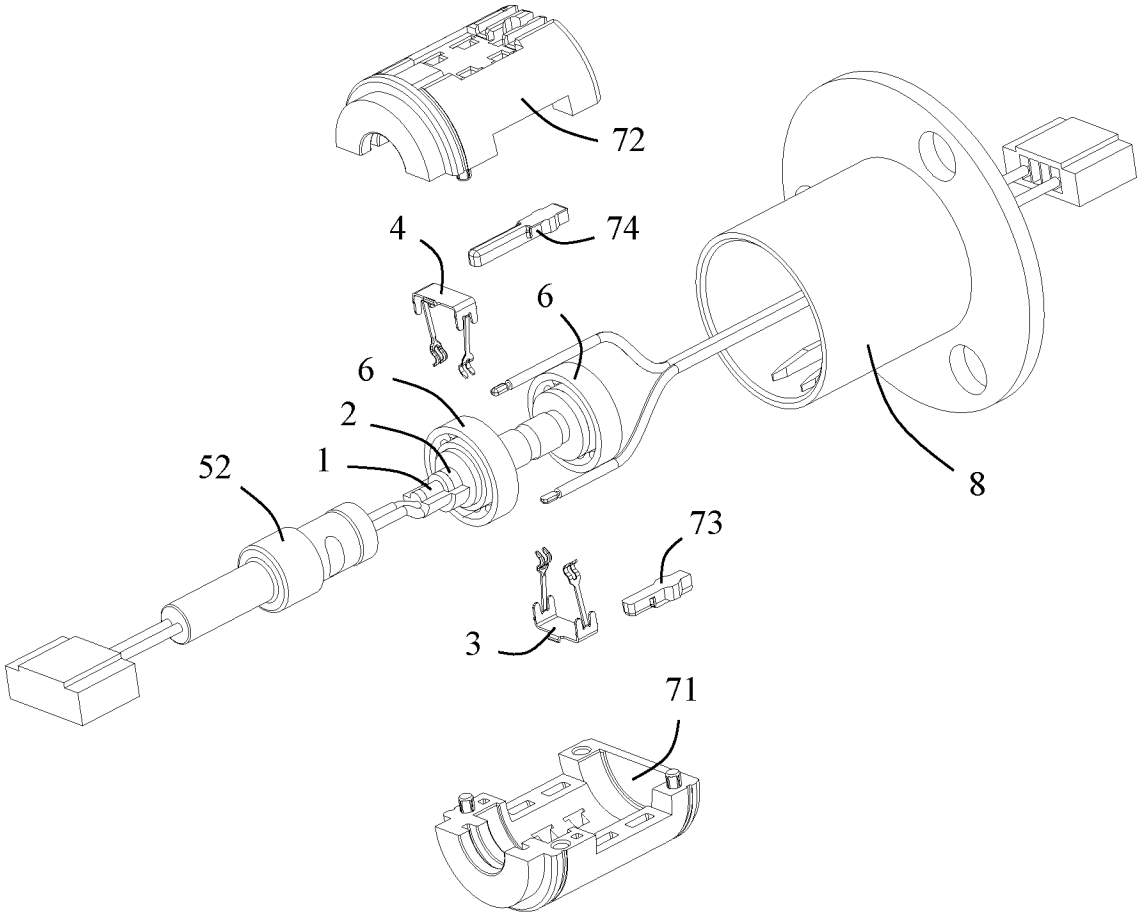
FIG. 7 is a further exploded view of FIG. 6.
Figure 8:
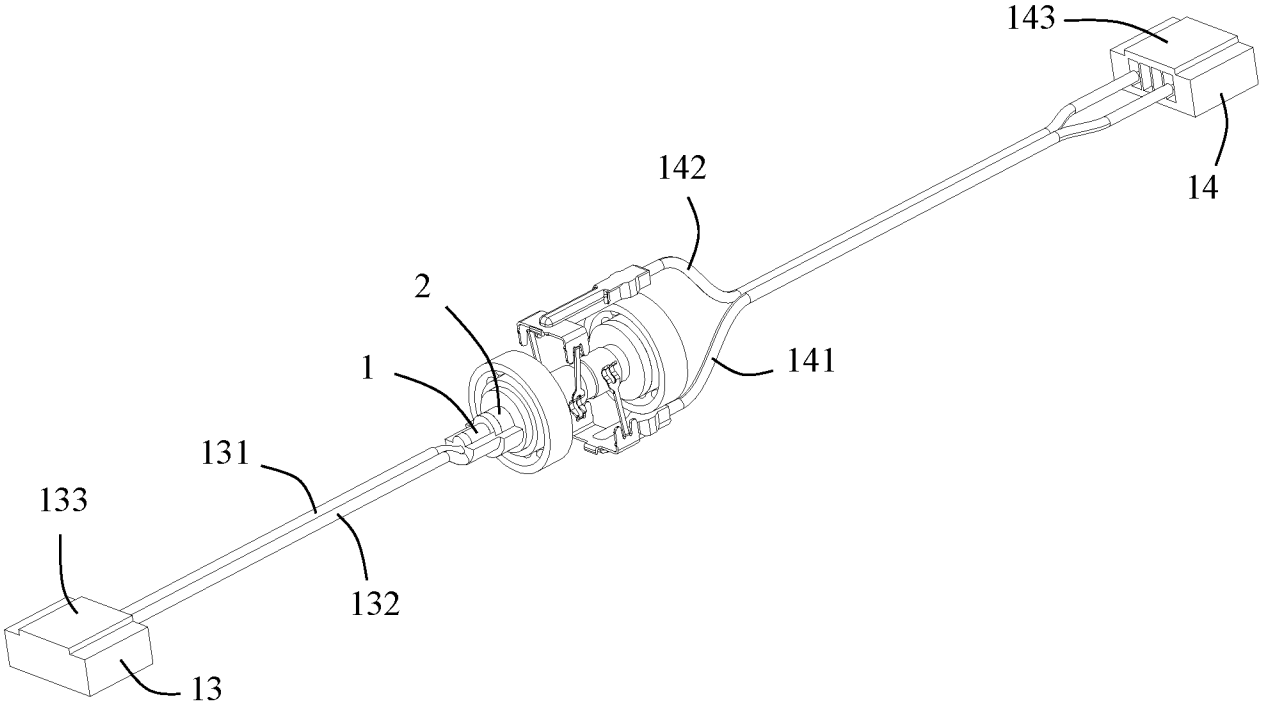
FIG. 8 is a schematic perspective view of the conductive slip ring with the shell, the housing and the protective cover in FIG. 5 removed.

Referring to FIG. 6, in the illustrated embodiment of the present disclosure, each of the third terminal 3 and the fourth terminal 4 includes a connection portion 30, a first contact arm 31 and a second contact arm 32. The first contact arm 31 and the second contact arm 32 are bent and extended from lateral sides of the connection portion 30, respectively. The first terminal 1 is rotatable relative to the third terminal 3, while keeping the first contact arm 31 and the second contact arm 32 of the third terminal 3 always clamp the first annular contact surface 111. The second terminal 2 is rotatable relative to the fourth terminal 4, while keeping the first contact arm 31 and the second contact arm 32 of the fourth terminal 4 always clamp the second annular contact surface 211.

Each of the third terminal 3 and the fourth terminal 4 may be of a symmetrical structure formed by stamping metal sheets. The first contact arm 31 and the second contact arm 32 may be provided with one or two or more contact points 33 to ensure contact reliability with the first terminal 1 and the second terminal 2. In addition, in the illustrated embodiment of the present disclosure, each of the third terminal 3 and the fourth terminal 4 is provided with a pair of first contact arms 31 and a pair of second contact arms 32 which are cantilevered and symmetrically arranged. Although this cantilever structure provides better elastic force, it needs to avoid excessive deformation and unbalanced force. In the illustrated embodiment of the present disclosure, by providing the bearing 6, the "rotor" is capable of keeping a good coaxiality during rotation, thus the above-mentioned problem can be avoided to a certain extent.

The above embodiments are only used to illustrate the present application and not to limit the technical solutions described in the present application. The understanding of this specification should be based on those skilled in the art. Descriptions of directions, such as "front", "back", "left", "right", "top" and "bottom", although they have been described in detail in the above-mentioned embodiments of the present application, those skilled in the art should understand that modifications or equivalent substitutions can still be made to the application, and all technical solutions and improvements that do not depart from the spirit and scope of the application should be covered by the claims of the application.

What is claimed is:

1. A conductive slip ring comprising:

a first terminal group comprising:

a first terminal having a first contact portion and a first extension portion connected to the first contact portion, the first contact portion being provided with a first annular contact surface; and a second terminal which is not in contact with the first terminal, the second terminal having a second contact portion and a second extension portion connected to the second contact portion, the second contact portion being provided with a second annular contact surface; and a second terminal group comprising:

a third terminal in rotating contact with the first annular contact surface of the first terminal; and a fourth terminal in rotating contact with the second annular contact surface of the second terminal; wherein the first annular contact surface and the second annular contact surface are spaced apart from each other along an axial direction of the conductive slip ring; wherein the first extension portion extends through the second contact portion along the axial direction of the conductive slip ring and is at least partially inserted into the second extension portion; and wherein the first extension portion and the second extension portion are adapted to electrically connect with a first connection port, and the third terminal and the fourth terminal are adapted to electrically connect with a second connection port.

2. The conductive slip ring according to claim 1, further comprising a molded part with which the first terminal and the second terminal are insert-molded; wherein the first contact portion and the second contact portion are spaced apart from each other along the axial direction of the conductive slip ring, the first contact portion is of a ring shape, the second extension portion is inserted into the first contact portion, and the second contact portion is of a ring shape or a cylindrical shape.

3. The conductive slip ring according to claim 2, wherein the molded part is provided with a support portion, the first extension portion has a first tail portion exposed on the support portion, and the second extension portion comprises a second tail portion exposed on the support portion; wherein the first connection port has a first cable connected to the first tail portion and a second cable connected to the second tail portion.

4. The conductive slip ring according to claim 3, further comprising a protective sleeve sleeved on the support portion to at least partially shield the first tail portion and the second tail.

5. The conductive slip ring according to claim 2, wherein the molded part is provided with a bearing seat and the conductive slip ring comprises a bearing mounted on the bearing seat, the bearing has an outer ring portion and an inner ring portion which is rotatable relative to the outer ring portion, the inner ring portion is fixed to the bearing seat; the conductive slip ring has a housing to fix the third terminal and the fourth terminal, the outer ring portion is fixed to the housing.

6. The conductive slip ring according to claim 5, wherein the second connection port is provided with a third cable connected to the third terminal and a fourth cable connected to the fourth terminal; the conductive slip ring has a first protection member covering a portion where the third terminal and the third cable are connected, and a second protection member covering a portion where the fourth terminal and the fourth cable are connected, both the first protection member and the second protection member are mounted to the housing.

7. The conductive slip ring according to claim 6, wherein the housing comprises a first housing and a second housing fixed to the first housing, the first protection member is mounted to the first housing, and the second protection member is mounted to the second housing.

8. The conductive slip ring according to claim 1, wherein a diameter of the first annular contact surface is the same as a diameter of the second annular contact surface.

9. The conductive slip ring according to claim 8, wherein each of the third terminal and the fourth terminal comprises a connection portion, a first contact arm and a second contact arm, the first contact arm and the second contact arm are bent and extended from lateral sides of the connection portion, respectively; wherein the first terminal is rotatable relative to the third terminal, while keeping the first contact arm and the second contact arm of the third terminal always clamp the first annular contact surface; and wherein the second terminal is rotatable relative to the fourth terminal, while keeping the first contact arm and the second contact arm of the fourth terminal always clamp the second annular contact surface.

10. The conductive slip ring according to claim 1, wherein one of the first terminal and the second terminal is a power terminal, and the other is a ground terminal.

11. A conductive slip ring comprising:

a first terminal group comprising:

a first terminal having a first contact portion and a first extension portion electrically connected to the first contact portion, the first contact portion being provided with a first annular contact surface;

a second terminal having a second contact portion and a second extension portion electrically connected to the second contact portion, the second contact portion being provided with a second annular contact surface; and a molded part insert-molded with the first terminal and the second terminal, the molded part comprising an isolation portion which separates the first contact portion and the second contact portion in an axial direction of the conductive slip ring;

a second terminal group comprising:

a third terminal electrically contacting with the first annular contact surface of the first terminal; and a fourth terminal electrically contacting with the second annular contact surface of the second terminal;

a first connection port electrically connected with the first extension portion and the second extension portion; and a second connection port electrically connected with the third terminal and the fourth terminal; wherein the first connection port is rotatable with respect to the second connection port while keeping the first terminal and the second terminal in rotating contact with the third terminal and the fourth terminal, respectively;

the molded part is provided with a support portion, the first extension portion has a first tail portion exposed on the support portion, and the second extension portion comprises a second tail portion exposed on the support portion;

the conductive slip ring further comprises a protective sleeve sleeved on the support portion to at least partially shield the first tail portion and the second tail.

12. The conductive slip ring according to claim 11, wherein the first connection port has a first cable welded to the first tail portion and a second cable welded to the second tail portion.

13. The conductive slip ring according to claim 11, wherein a diameter of the first annular contact surface is the same as a diameter of the second annular contact surface.

14. The conductive slip ring according to claim 13, wherein each of the third terminal and the fourth terminal comprises a first contact arm and a second contact arm; wherein the first terminal is rotatable relative to the third terminal, while keeping the first contact arm and the second contact arm of the third terminal always clamp the first annular contact surface; and wherein the second terminal is rotatable relative to the fourth terminal, while keeping the first contact arm and the second contact arm of the fourth terminal always clamp the second annular contact surface.

15. The conductive slip ring according to claim 14, wherein the third terminal and the fourth terminal are of the same configuration.

16. A conductive slip ring comprising:

a first terminal group comprising:

a first terminal having a first contact portion and a first extension portion electrically connected to the first contact portion, the first contact portion being provided with a first annular contact surface;

a second terminal having a second contact portion and a second extension portion electrically connected to the second contact portion, the second contact portion being provided with a second annular contact surface; and a molded part insert-molded with the first terminal and the second terminal, the molded part comprising an isolation portion which separates the first contact portion and the second contact portion in an axial direction of the conductive slip ring;

a second terminal group comprising:

a third terminal electrically contacting with the first annular contact surface of the first terminal; and a fourth terminal electrically contacting with the second annular contact surface of the second terminal;

a first connection port electrically connected with the first extension portion and the second extension portion; and a second connection port electrically connected with the third terminal and the fourth terminal; wherein the first connection port is rotatable with respect to the second connection port while keeping the first terminal and the second terminal in rotating contact with the third terminal and the fourth terminal, respectively;

the molded part is provided with a pair of bearing seats in which the first terminal and the second terminal are located, and the conductive slip ring comprises a pair of bearings mounted on the bearing seats, each bearing comprises an outer ring portion and an inner ring portion which is rotatable relative to the outer ring portion, the inner ring portions are fixed to the bearing seats; the conductive slip ring comprises a housing to fix the third terminal and the fourth terminal, the outer ring portions are fixed to the housing;

the second connection port is provided with a third cable welded to the third terminal and a fourth cable welded to the fourth terminal; the conductive slip ring comprises a first protection member covering a portion where the third terminal and the third cable are welded, and a second protection member covering a portion where the fourth terminal and the fourth cable are welded.

17. The conductive slip ring according to claim 16, wherein the housing comprises a first housing and a second housing fixed to the first housing, the first protection member is mounted to the first housing, and the second protection member is mounted to the second housing.

18. The conductive slip ring according to claim 17, further comprising a shell enclosing the housing, the housing and the shell are assembled and fixed together through a plurality of grooves and a plurality of protruding ribs received in the grooves, the protruding ribs extending along the axial direction of the conductive slip ring.

* * * * *